US010595576B1

(12) United States Patent
Hopkins

(10) Patent No.: US 10,595,576 B1
(45) Date of Patent: Mar. 24, 2020

(54) RESILIENT GARMENT FASTENER

(71) Applicant: Charles Hopkins, Shawnee, KS (US)

(72) Inventor: Charles Hopkins, Shawnee, KS (US)

( * ) Notice: Subject to any disclaimer, the term of this patent is extended or adjusted under 35 U.S.C. 154(b) by 0 days.

(21) Appl. No.: 16/178,119

(22) Filed: Nov. 1, 2018

(51) Int. Cl.
*A41F 17/00* (2006.01)
*A41D 1/22* (2018.01)
*A41D 1/14* (2006.01)

(52) U.S. Cl.
CPC ..... *A41F 17/00* (2013.01); *A41D 1/14* (2013.01); *A41D 1/22* (2013.01)

(58) Field of Classification Search
CPC ..... A41F 17/00; A41D 1/14; A41D 1/22
See application file for complete search history.

(56) References Cited

U.S. PATENT DOCUMENTS 2,567,277 A * 9/1951 Farquhar ..... A41F 11/02 2/312
4,596,569 A * 6/1986 Campbell ..... A41F 17/00 604/387
4,937,886 A * 7/1990 Ellis ..... A41F 17/00 2/323
9,044,054 B2 * 6/2015 Raymer, Jr. ..... A41D 27/12
9,414,705 B2 * 8/2016 Sclafani ..... A41F 11/16
9,924,752 B2 * 3/2018 Horrey ..... A41F 17/02
10,165,815 B1 * 1/2019 Branker ..... A41F 17/00
2019/0014844 A1 * 1/2019 Osman ..... A41F 17/00
2019/0082743 A1 * 3/2019 Koen ..... A41B 1/06
2019/0082761 A1 * 3/2019 Koen ..... A41F 17/00

* cited by examiner

*Primary Examiner* — Victor D Batson
*Assistant Examiner* — Matthew J Sullivan
(74) *Attorney, Agent, or Firm* — Arthur K. Shaffer; Intellectual Property Center, LLC

(57) ABSTRACT

The present invention provides an improved garment fastener, wherein in one aspect it secures a garment panel during windy conditions, the garment fastener including a garment anchor and a plurality of elongated straps, the garment anchor adapted for releasable receipt of the elongated straps, each of the elongated straps extendable laterally from the garment anchor towards the garment panel, a panel connector adapted for connection to the garment panel, the panel connector having a threadable aperture for receipt of at least a portion of the extendable strap and the garment anchor secures the garment panel along the axis of elasticity.

1 Claim, 3 Drawing Sheets

RESILIENT GARMENT FASTENER

CROSS-REFERENCE TO RELATED APPLICATION

This application is a non-provisional application claiming the benefit of the prior filed U.S. provisional application No. 62/587,663, filed Nov. 17, 2017 which is incorporated herein by reference.

FIELD OF THE INVENTION

The present invention is broadly directed to clothing fasteners and more particularly to an improved garter with a resilient mounted garment fastener for securely retaining the garment during use, including windy conditions.

BACKGROUND OF THE INVENTION

Clothing fasteners are generally well known and provide for various mechanisms for securing garments and providing a garment structure presented by the worn clothing. Many of these fasteners include generally known mechanical fasteners such as, but not limited to, hook and loop, interlocking zippers, and button and hole combination fasteners to secure various items of clothing in a predefined position. Generally, these fasteners do not allow for flexibility or expandability during use. Some of these fasteners are fixed between a pair of garment ends, to a particular location or at a particular distance. Use of these fasteners may pull the secured garment structure during use. In some cases, the wearer must alter their body mechanics or physical structure to conform to the inflexible garment with the fixed fastener. Therefore, these generally known fasteners provide limited use when fastening garments which may require flexibility or expandability in operation.

Various apparatuses are disclosed that secure articles of clothing in a downward angle. For example, apparatuses for holding down one's shirt are known. U.S. Pat. No. 4,937,886, issued to Ellis on Jul. 3, 1990 and entitled "Infant Shirt Hold-Down", teaches an apparatus with a wide, elongated elasticized section from which extends a pair of straps from each end thereof, with an operable fastener being provided at the end of each strap. The apparatus is intended to hold down a child's upper garment, such as a shirt. Ellis teaches that the apparatus is passed between the child's legs and the strap fasteners are fastened to the lower edges of the upper garment holding the shirt in a downward angle. Another example of patents which disclose a device which holds a garment in a downward direction includes U.S. Pat. No. 5,177,813, issued to Bosack and entitled "Shirttail Retaining Harness"; U.S. Pat. No. 5,177,814, issued to Courtney and entitled "Shirt Retainer"; and U.S. Pat. No. 5,276,923, issued to Cohen and entitled "Shirt Hold-Down Device"

The above-described references related to shirttail retaining apparatuses disclose a device that would retain a shirt in a generally downward direction which would not be usable in the case of a garment worn on the lower extremities, but simply relate to securing an upper garment. Moreover, the fastening mechanisms contemplated for use with the shirttail retaining apparatuses are garter clips or jawed hinge clips, which require more dexterity and would be visible on the outer surface of the garment.

In contradistinction from the above-described devices, suspenders or suspender-like devices are known for holding up trousers or lower garments, rather than holding down upper garments. A disclosure for suspenders is found in U.S. Pat. No. 5,172,429, issued to Lucier and assigned on its face to New England Accessories. Therein, Lucier discloses combination suspenders having interchangeable clip ends and button strap ends connected to the suspender straps for use with either button or buttonless trousers. While suspenders such as disclosed by Lucier are useful in supporting a lower garment, the clips contemplated for engaging the lower garment are jawed hinged clips which are openable and closeable via a latching lever. Like garter clips, jawed hinged clips require one to position the clothing between the jaws and then secure the clothing by engaging a lever and which are visible along the outer surface.

U.S. Pat. No. 5,313,669, issued to Rasdell et al. and entitled "Clothing Anchor Apparatus", teaches an apparatus for securing clothing in position, and is particularly contemplated to anchor the front and back tails of shirts along the crotch area and providing a means for housing secret papers. Again, this appears to be limited to holding an upper extremities garment in a downward direction. This does not disclose nor would it be suitable for maintaining a lower extremities garment.

The fasteners employed by each of the above-described apparatuses provides a front facing structure which is designed for pinching the garment between a pair of clips such that the front facing structure can be visible along the outer surface of the garment panel.

It would be desirable to develop a lower garment suspension apparatus with flexible and resilient members employing fasteners which are easily separated but which are not visible from the front facing surface of the garment panel.

Accordingly, there is a need for an improved clothing fastener which secures a garment against hostile ambient conditions and addresses at least a portion of the aforementioned shortcomings.

SUMMARY OF THE INVENTION

The present invention includes an improved resilient wind resistant garment fastener which at least partially secures a portion of a garment or garment panel during windy conditions said garment fastener comprising a garment anchor and a plurality of elongated straps, said garment anchor adapted for releasable receipt of said elongated straps, said elongated strap extendable laterally along an axis of elasticity extending outwardly from said garment anchor along said elongated strap towards said garment panel, a panel connector adapted for releasable connection to an inside surface of said garment panel, said panel connector having a threadable aperture for receipt of at least a portion of said extendable strap whereby said strap is threaded through said threaded aperture, and said garment anchor securing said garment panel along said axis of elasticity.

Various objects and advantages of the present invention will become apparent from the following description taken in conjunction with the accompanying drawings wherein are set forth, by way of illustration and example, certain embodiments of this invention. The drawings submitted herewith constitute a part of this specification, include exemplary embodiments of the present invention, and illustrate various objects and features thereof.

Certain embodiments of the invention are outlined above in order that the detailed description thereof may be better understood, and in order that the present contributes to the art may be better appreciated. There are, of course, additional embodiments of the invention that will be described below and which will form the subject matter of any claims appended hereto.

In this respect, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein as well as the abstract are for the purposes of description and should not be regarded as limiting.

As such, those skilled in the relevant art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Though some features of the invention may be claimed in dependency, each feature has merit when used independently.

Various objects and advantages of the present invention will become apparent from the following description taken in conjunction with the accompanying drawings wherein are set forth, by way of illustration and example, certain embodiments of this invention. The drawings submitted herewith constitute a part of this specification, include exemplary embodiments of the present invention, and illustrate various objects and features thereof.

BRIEF DESCRIPTION OF THE DRAWINGS

Further features of the present invention will become apparent to those skilled in the art to which the present invention relates from reading the following description with reference to the accompanying drawings, in which a better understanding of the present invention is depicted, in which.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
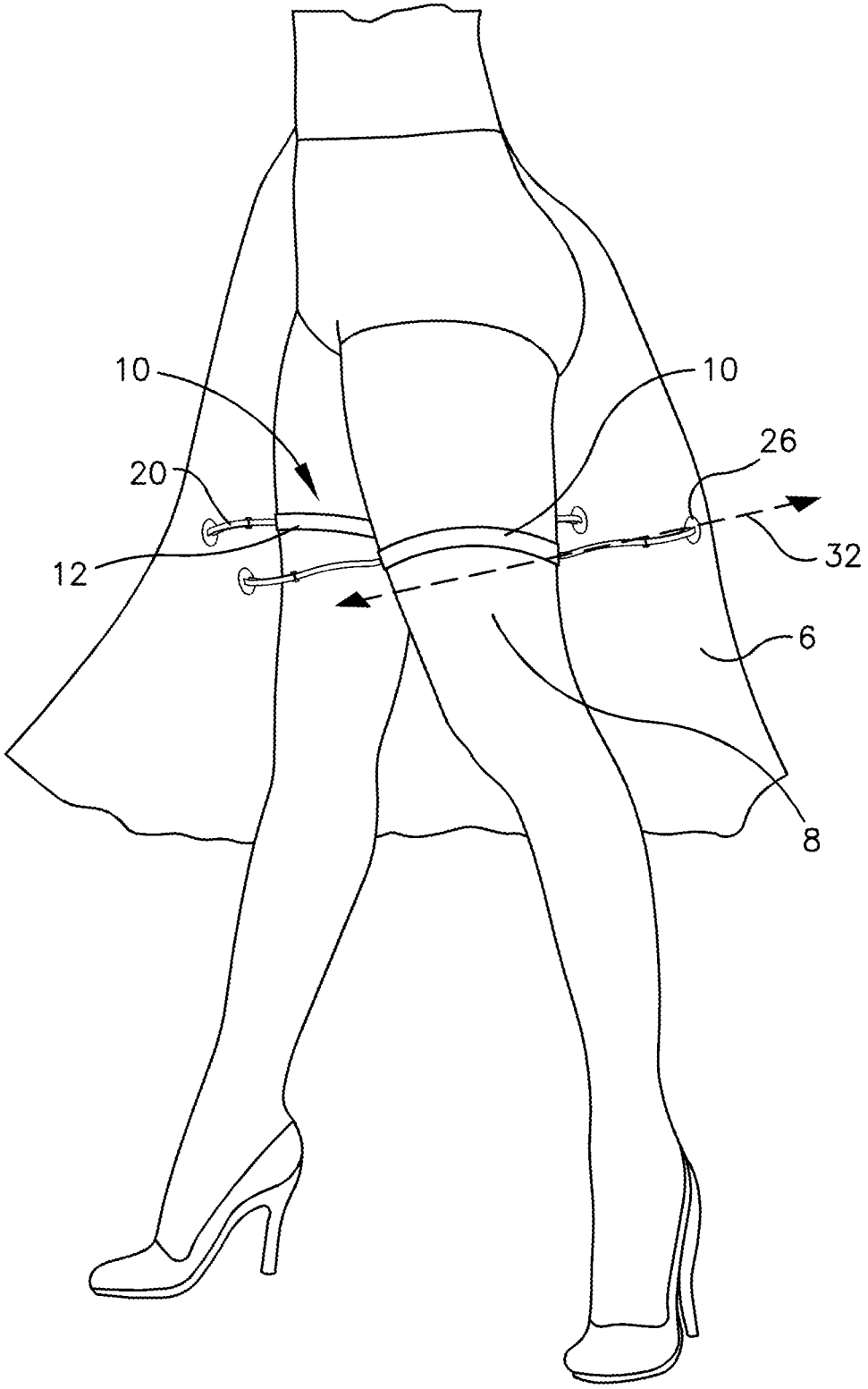
FIG. 1 is a left side perspective view of an exemplary embodiment of the present invention connectably secured to a garment.
Figure 2:
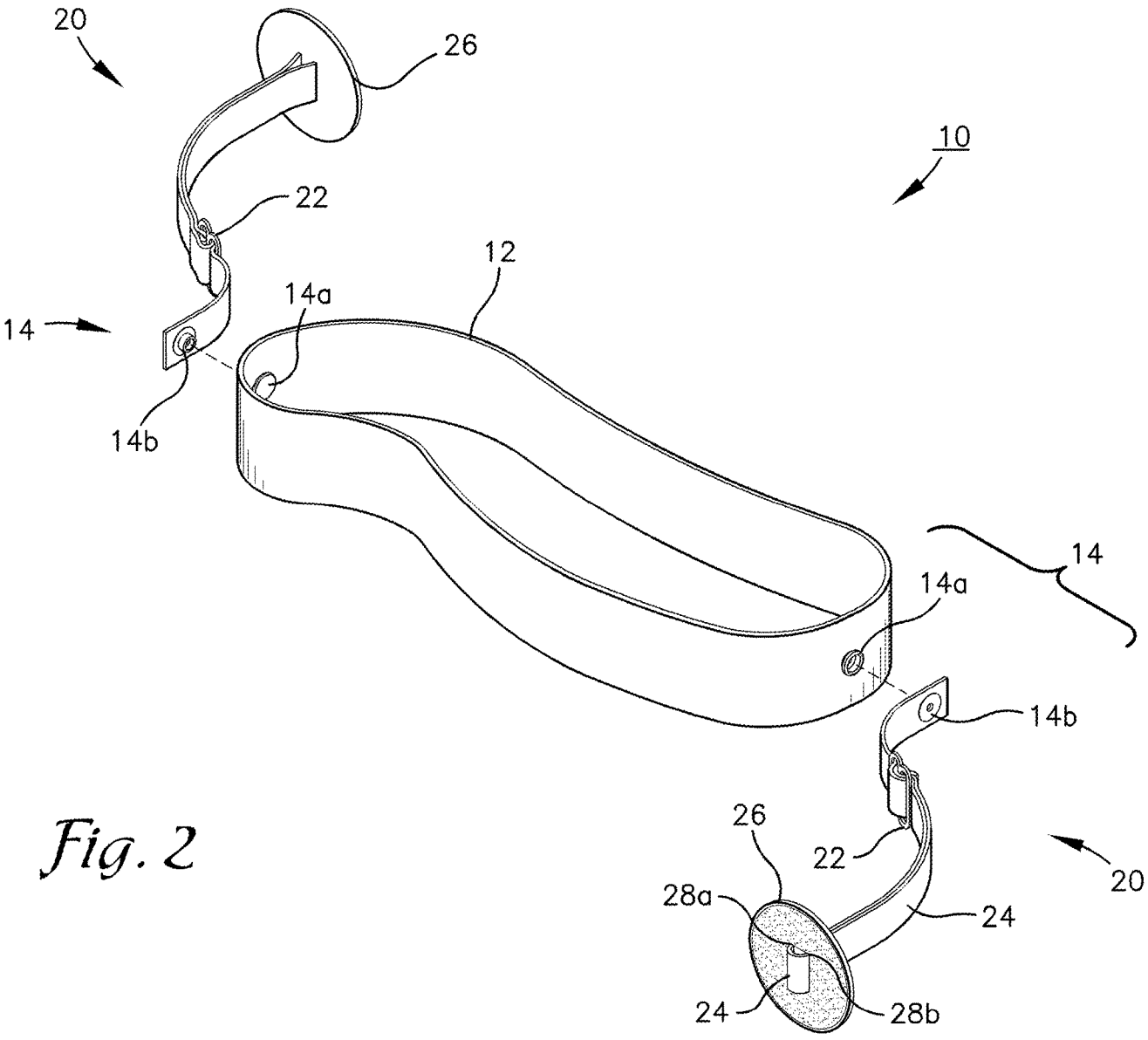
FIG. 2 is an exploded side perspective of the exemplary embodiment of the invention with a pair of exemplary fasteners and a detachable band.

Referring to the drawings in more detail, the reference numeral 10 generally refers to an embodiment of the present invention, an improved resilient garment fastener, at least partially securely maintains a garment panel 6 during wearable use, by example, in windy conditions. An embodiment of the improved resilient garment fastener 10 is depicted in FIG. 1 with a garment anchor 12 which includes at least one releasable fastener 14 adapted for securing an elongated strap 20. The releasable fastener 14 is illustrated in FIG. 2 as a snap fastener with complementary female and male fittings 14*a*, 14*b*. Fasteners, being generally known, may include a number of different complementary features for securing the resilient fasteners 20 to the compression band 12. The embodiment depicted in FIG. 2 is depicted with a pair of releasable fasteners 14 spaced along the garment anchor 12 on generally opposite sides of the garment anchor 12 and which are each generally adapted for removable receipt of the resilient elongated strap 20.

The embodiment of the improved resilient garment fastener 10 depicted in FIG. 1 includes a garment anchor 12 and a plurality of extendable elongated straps 20 which are fastened to the garment anchor 12. Generally, the garment anchor 12 is designed to anchor the garment panel 6 while extending elastically around a structure, such as a users leg 8 or waist, which is generally stationary with respect to the garment panel 6. In the depicted embodiment of FIG. 1, the garment panel 6 is associated with a women's dress. The garment anchor 12 may be fabricated from a variety of materials including synthetic or natural materials which can exert an inwardly directed force as the elongated straps 20 are extended outwardly from the garment anchor 12. The garment anchor 12 is configured to exert a reciprocal movement as the garment panel 6 moves back and forth during movement by the wearer. Generally, the elongated straps 20 extend laterally along an axis of elasticity 32 which extends between the junction of the garment anchor 12 and one end of the elongated strap 20 associated with the garment anchor 12 and the panel connector 26 associated with the garment panel 6. The axis of elasticity 32 extends centrally from the structure through the junction of the garment anchor 12 and the elongated strap 20 towards the releasable fastener 14 and is generally aligned with the reciprocal movement of the elongated strap 20. Generally, the axis of elasticity 32 extends outwardly horizontally from the releasable fastener 14 associated with the garment anchor 12. Additionally, plural axis of elasticity 32 may extend outwardly from the garment anchor 12, each axis of elasticity 32 corresponding to each elongated strap 20 extending from a releasable fastener 14.

Various embodiments for joining the elongated straps 20 to the garment anchor 12 may be utilized, including one or more fasteners or complementary fastening mechanisms which may be spaced along the compression band 12 as desired for fastening the elongated straps 20 to the garment anchor 12.

One embodiment of the improved resilient garment fastener 10 illustrated in FIG. 1 includes a pair of the garment anchors 12, adapted for placement on anchoring support structures depicted as legs 8, each elongated strap 20 being connectably secured to one or more garment panels 6 with one or more panel connectors 26.

Generally, the garment anchor 12 includes an outer surface and an inner surface which in one embodiment includes a frictional membrane extending circumferentially along the inner surface. Other embodiments of the garment anchor 12 may remove the frictional membrane for rotation and alignment of elongated straps 20 along a central axis of elasticity 32 extending from the elongated strap 20 during attachment while the garment panel 6 is outwardly extended. The garment anchor 12 may be opaque or translucent and may include a moisture barrier to keep moisture from the garment panel or alternatively, a moisture wicking material to transport any moisture away from the anchor structure depicted as a wearer's leg 8, as desired. Generally, the garment anchor 12 has an elastic property continuously along its surface for anchoring the garment panel 6 while allowing for expandability during installation and removal from an anchoring structure such as a leg 8 while permitting further expansion during movement and wear as desired.

In one embodiment, garment anchor 12 at least partially includes a resilient material like lycra which allows for expansion while getting dressed or undressed and compression during use. In one embodiment, the garment anchor 12 is also breathable and moisture wicking allowing moisture from the skin to pass to the outer surface of the garment anchor 12 to allow for evaporation which may help cool the wearer during use.

Figure 3:
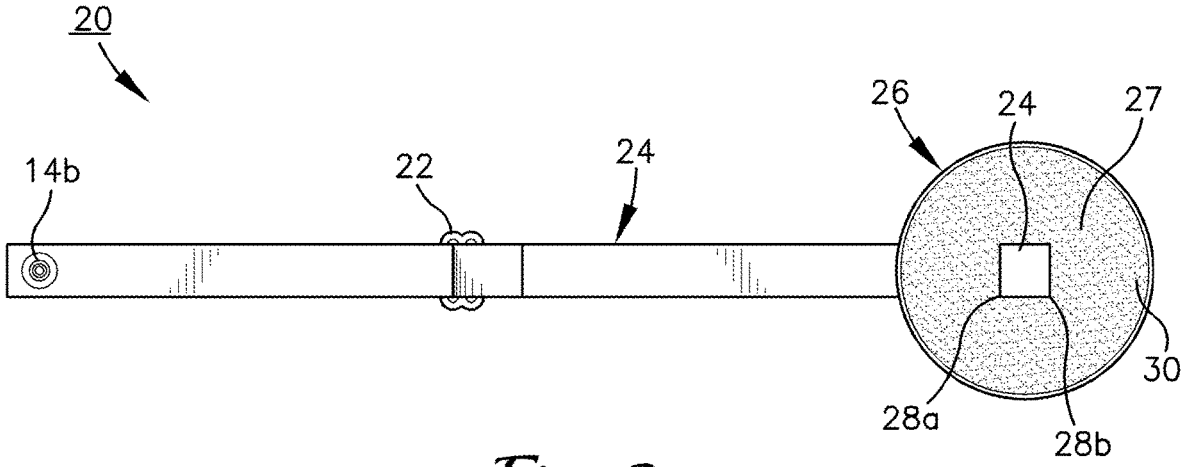
FIG. 3 is a top plan view of one of the exemplary fasteners of FIG. 2.
Figure 4:
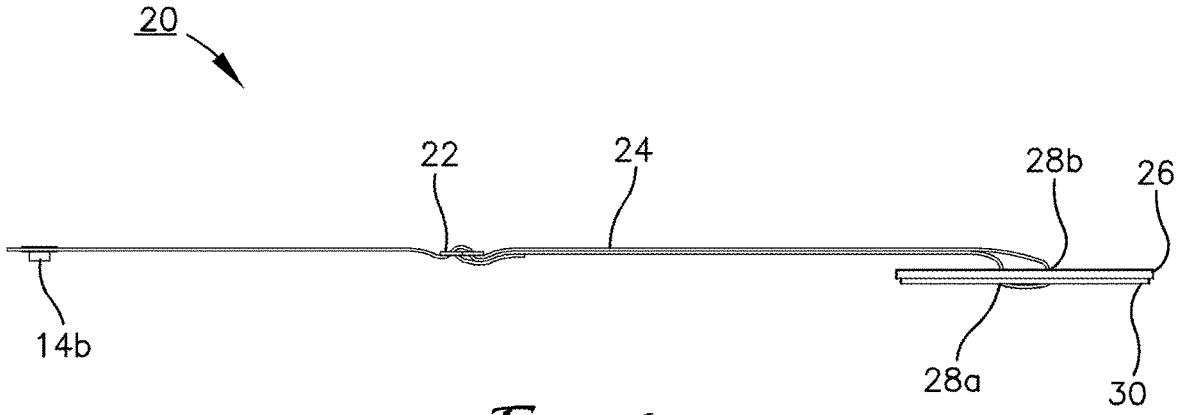
FIG. 4 is a side elevation of one of the exemplary fasteners of FIG. 2.

Each elongated strap 20, also referred to herein as a resilient fastener, generally depicted in FIGS. 2-4 is illustrated as being adapted for outward extension from opposite sides of the garment anchor 12 and while securing the garment panel 6 during use. The elongated strap 20 generally includes an adjustable member 22 to help adjust the length of a strap 24 which in one embodiment is fabricated made from an elastic material and extends between the compression band 12 and the garment panel 6. The fastener 14 is generally located at one end of the elongated strap 20, opposite the panel connector 26 which is generally open-faced and substantially planar for securing the garment panel 6 in a generally fixed position with respect to the garment anchor 12.

Example materials which may be used for the panel connector 26 include but are not limited to plastics and metals. In one embodiment, the panel connector 26 may comprise a single piece cut, stamped or molded for example using an injection molding process with for example a central aperture and a pair of elongated strap receivers. It may be rigid or flexible. It may also be fabricated as multiple pieces that can be selectively assembled and disassembled as desired. In yet another exemplary embodiment, the panel connector 26 may be layered with different materials, each having different properties and different shapes as desired.

The embodiment of the panel connector 26 depicted in FIGS. 2-4 is generally circular with the strap 24 extending through the first elongated strap receiver 28*a* and back through the second elongated strap receiver 28*b* for securing the panel connector 26 in central alignment along the circular interior. For example, the panel connector 26 may include a central aperture (not shown) spanned by the first and second elongated strap receivers 28*a*, 28*b* which are illustrated as a pair of slotted grooves for threaded receipt of the strap 24 therethrough. The circular interior 27 may optionally include the central aperture (not shown) which may be adapted for a receipt of a fastener structure (not shown) like a button or snap. Alternatively, the panel connector 26 may include an outer membrane 30 which may adhesively or mechanically secure the panel connector 26 to the garment panel 6 with, for example, tape, hook and loop fasteners or it may include a magnetically responsive structure which corresponds to a complementary magnetic structure positioned, as desired, along or within the garment panel 6.

Generally, the improved resilient garment fastener 10 secures the garment panel 6 to an anchoring structure such as the leg 8 and maintains the panel 6 in an inward, horizontal orientation, for example, towards the wearer's leg 8 during windy conditions while allowing for inward and outward movement along an axis of elasticity 32. For quick and easy release, the panel connector 26 may be removed from the panel 6 or the fasteners 14 can be unfastened, separating the elongated straps 20 from the garment anchor 12, to allow the garment panel 6 to be lowered or raised as desired. The illustrated panel connector 26 may also be flexible to allow it conform to the contours of the garment panel 6 and to be nearly imperceptible from the front of the garment panel 6.

In operation, the improved resilient garment fastener 10 is adapted for anchoring the garment panel 6 to a support structure which is illustrated as leg 8. Each of the improved resilient garment fasteners 10 illustrated in FIG. 1 secure opposite sides of the garment panel 6 with first and second panel connectors 26 joined to the garment anchor 12 by a pair of elongated straps 20 releasably fastened. As the garment panel 6 moves as a result of movement of the anchoring structure or from ambient conditions such as wind, the elongated straps 20 anchored to the garment anchor 12 elastically extend inwardly and outwardly from the garment anchor 12 along the axis of elasticity 32. Optionally the garment anchor 12 may rotate as desired to align the elongated straps 20 in a generally aligned orientation during movement, the elongated straps 20 extending from the panel connectors 26 connectably secured to opposite garment panel 6 areas.

The adjustment member 22 allows the resilient fasteners to be extended outwardly from the garment anchor 12 a desired distance for securing the garment panel 6. In one embodiment, the panel connectors 26 can be adjusted to extend from the garment anchor 12 a distance between 2 and 8 inches, the elongated strap 20 having sufficient elastic properties to extend up to another 50%. The adjustment member 22 may be fabricated from metal or plastic and includes receiving structure such as, but not limited to, a pair of elongated channels for adjustably receiving the elongated strap 20 and providing easy adjustment of the panel connector 26 for extension between the garment anchor 12 and the garment panel 6. Generally, the adjustment member 22 is located along the elongated strap 20 between the panel connector 26 and the fastener 14.

It is to be understood that while certain forms of the present invention have been illustrated and described herein, it is not to be limited to the specific forms or arrangement of parts describer herein. Other arrangements or embodiments, changes and modifications not precisely set forth, which can be practiced under the teachings of the present invention are to be understood as being included within the scope of this invention as set forth in the claims below.

What is claimed and desired to be secured by Letters Patent:

1. An improved garment fastener for securing a garment panel, said garment fastener comprising:

a garment anchor releasably connected to a pair of elongated straps;

a plurality of releasable fasteners spaced along said garment anchor, each releasable fastener releasably fastening one of said pair of said elongated straps to said garment anchor;

each of said elongated straps being selectively removable from said garment anchor, wherein said elongated straps extends between one of said plurality of releasable fasteners and a panel connector;

said pair of elongated straps presenting an axis of elasticity as the pair of elongated straps extends from opposite sides of said garment anchor to said garment panel in response to inward and outward movement of the garment panel; and said panel connector having an outer membrane for releasable connection to the garment panel.

* * * * *